US008201590B2

(12) United States Patent
Houzego

(10) Patent No.: US 8,201,590 B2
(45) Date of Patent: Jun. 19, 2012

(54) METHOD AND APPARATUS FOR FILLING A CONTAINER

(75) Inventor: Peter John Houzego, Oakington (GB)

(73) Assignee: Pfizer, Limited, Sandwich, Kent (GB)

( * ) Notice: Subject to any disclaimer, the term of this patent is extended or adjusted under 35 U.S.C. 154(b) by 870 days.

(21) Appl. No.: 10/581,668

(22) PCT Filed: Aug. 4, 2004

(86) PCT No.: PCT/GB2004/003380

§ 371 (c)(1),
(2), (4) Date: Oct. 12, 2006

(87) PCT Pub. No.: WO2005/014397

PCT Pub. Date: Feb. 17, 2005

(65) Prior Publication Data

US 2007/0102058 A1 May 10, 2007

(30) Foreign Application Priority Data

Aug. 6, 2003 (GB) ..... 0318437.1

(51) Int. Cl.
*B65B 1/14* (2006.01)

(52) U.S. Cl. ..... 141/73; 141/11; 141/71; 141/72; 53/437

(58) Field of Classification Search ..... 141/11, 141/69–75; 53/437, 473
See application file for complete search history.

(56) References Cited

U.S. PATENT DOCUMENTS

| | | | | |
|---|---|---|---|---|
| 1,724,113 | A * | 8/1929 | Small | 222/197 |
| 2,857,938 | A * | 10/1958 | Wahl | 141/71 |
| 3,078,685 | A * | 2/1963 | Flournoy | 53/432 |
| 3,306,323 | A | 2/1967 | Aronson | |
| 3,336,955 | A * | 8/1967 | Feldman et al. | 141/72 |
| 4,944,334 | A | 7/1990 | McGregor | |
| 4,966,204 | A | 10/1990 | Pedigo | |
| 5,315,810 | A * | 5/1994 | Eaton | 53/473 |
| 6,360,787 | B1 * | 3/2002 | Williamson | 141/74 |
| 7,051,771 | B2 * | 5/2006 | Ede et al. | 141/71 |
| 2004/0060265 | A1 | 4/2004 | Boeckle et al. | |

FOREIGN PATENT DOCUMENTS

| | | |
|---|---|---|
| EP | 1055601 | 11/2000 |
| EP | 1354795 A2 | 10/2003 |
| FR | 2030525 A | 11/1970 |
| JP | 10180492 | 7/1998 |
| WO | WO 97/05018 | 2/1997 |
| WO | WO99/19215 A1 | 4/1999 |

(Continued)

OTHER PUBLICATIONS

FR 2030525 French Patent Abstract. Nov. 2, 1970.

(Continued)

*Primary Examiner* — Timothy L Maust
(74) *Attorney, Agent, or Firm* — Kramer & Amado, P.C.

(57) ABSTRACT

A method and apparatus for filling with powder (4) a container (8) having an open end, including positioning an outlet of a hopper (2) containing powder above the open end of the container (8), mechanically agitating the hopper so as to cause powder (4) to be transferred from the hopper to the container and mechanically agitating the container, wherein the steps of mechanically agitating are conducted by at least a predetermined amount sufficient to ensure that the container is filled with powder at a predetermined density.

18 Claims, 5 Drawing Sheets

FOREIGN PATENT DOCUMENTS

| | | | |
|---|---|---|---|
| WO | WO01/33176 | A1 | 5/2001 |
| WO | WO02/44669 | A1 | 6/2002 |
| WO | WO03/026965 | A1 | 4/2003 |
| WO | WO03/066436 | A1 | 8/2003 |

OTHER PUBLICATIONS

JP 10-180492 Japanese Patent Abstract. Jul. 7, 1998.

Great Britain International Search Report—Application No. GB 0318437.1, Jan. 15, 2004, 3 pages.

PCT/GB04/003380—Publication No. WO 05/014397, PCT International Search Report; dated Nov. 9, 2004; 4 pages.

* cited by examiner

METHOD AND APPARATUS FOR FILLING A CONTAINER

The present invention relates to a method of filling with powder a container having an open end, a method of simultaneously filling a plurality of such containers and an apparatus for carrying out such methods.

When factory packing unit doses of drug into individual containers, there is a requirement to achieve protection of the drug from the atmosphere. The fill weight (drug mass) must be accurate, aiming for better than 5% RSD (relative standard deviation).

Cohesive powders are difficult to push into a small container, because they stick to the walls and to themselves, causing inhomogeneous filling. If high force is used to overcome this, then the powders compact into a solid mass. This is especially disadvantageous for DPI (dry powder inhalation) applications where the powder must be sucked out of the container by the patients inhaled air stream.

Methods are known for filling. Dosators tubes can be used. The tube is pushed into a powder bed, lifted out with powder stuck in the tube and moved to the container. The powder is then pushed out of tube into the container. It is also known to push a container into a powder bed upside down, such that powder sticks in the container, and then wipe off the excess. It is also known to tap powder into the container, weigh the container and stop tapping when the container holds the right amount. Finally, it is known to suck powder into a transfer tube of known volume, transfer the tube to the container and blow out the powder into the container.

Generally these methods have difficulty filling a small container so that it is full to the brim with no powder deposited on the surface surrounding the container, and the density in the pocket is higher than bulk density.

Wo 97/05018 describes a method and apparatus for filling cavities, in particular for filling cavities with a powder which is in a free-flowing agglomerated form and is made to flow from a hopper by subjecting the hopper to vibration. It indicates that it is possible to accurately switch the flow of the powder on and off using vibrations. The cavities may be formed in a disc with a circular configuration. The disc can be placed on a turntable and subjected to vibrations. This document explains that the effect of the vibrations is to cause the cavities at the periphery of the dose ring to fill uniformly with powder as they pass underneath the hopper outlet. The vibrations also to cause excess powder in the cavities and on the upper face of the dose ring to move along the face to the next cavity or to fall of the edge of the dose ring. This document also teaches the possibility of locking the dose holder (in which the cavities are formed) and the hopper into engagement, such that the powder flows directly into each cavity and the upper face of the dose holder between the cavities remains clean of powder.

Thus, WO 97/05018 teaches a system which uses vibrations to ensure that each cavity is properly filled. The vibrations ensure that powder flows from the hopper to the cavity and then ensures that the powder continues to flow within the cavity, such that it does not leave spaces or air pockets to the side or in the middle of the cavity and, in this sense, achieves a uniform density. However, in WO 97/05018, the actual density of the resulting powder in the cavity is not considered. WO 97/05018 proposes one system where vibrations are provided until the cavity is completely full and another system which, on the basis that the flow rate of powder into the cavity is substantially constant provided that the amplitude and frequency of vibration remains constant, determines the fill weight by carefully timing the duration of vibrator operation. There is no consideration of the fact that, for a particular volume, for instance the total volume of the cavity, the density of the powder can vary, such that fill weight will vary. This is different to merely ensuring that the volume is full of powder and has no air pockets or spaces.

It is an object of the present invention to overcome or at least reduce the shortcomings of previous methods and devices.

The present invention is based on the realisation that a predetermined mechanical agitation of a container containing powder will result in that powder settling over time to a stable predetermined and reproducable density. The mechanical agitation should cause vertical acceleration to the particles of powder and is preferably produced by tapping.

According to the present invention there is provided a method of filling with powder a container having an open end, the method including positioning an outlet of a hopper containing powder above the open end of the container, mechanically agitating the hopper so as to cause powder to be transferred from the hopper to the container, and mechanically agitating the container wherein the steps of mechanically agitating are conducted by at least a predetermined amount sufficient to ensure that the container is filled with powder at a predetermined density.

By mechanically agitating the hopper, powder will be transferred from the hopper to the container. By then mechanically agitating the container, the powder will settle in the container and be brought to the reproducible condition known as "tap density". The powder will be brought to the tap density after a predetermined amount of agitation to the container. Further agitation will not increase the density by any significant amount. Hence, in this way, it is not necessary to monitor the amount of powder in the container. The amount of agitation provided to the container can be measured, for instance, by the time for which the container is agitated, the number of taps given to the container or the frequency or magnitude of vibration. Where the container is of a known volume and filling is carried out to a predetermined level, for instance, determined by the outlet of the hopper, a known mass of powder can be provided on the basis of a predetermined density. Additionally, it is possible to end the tapping at a point before tap density has been achieved. During the last portion of tapping to reach tap density, the container will be fully filled with powder with the density increasing slowly with each tap.

Additionally, in this range, typically above 90% of tap density, the behavior of the powder is very reproducible. Thus, by altering the number of taps used, it is possible to fully fill the container and control the density of the powder within it in a reproducible way over the range from 90% to 100% of tap density. This enables small alterations to the fill weight to be achieved. This is useful to allow for batch-to-batch variations in the powder.

Preferably the method includes using the volume of the container to define a predetermined volume for the powder.

In this way, a predetermined mass can be achieved by virtue of the predetermined volume.

Preferably the method further includes filling the entire volume of the container with powder, the volume of the container equalling the predetermined volume.

In this way, the volume of the container can be used to determine the mass of powder.

Preferably the method includes, for at least some of the step of mechanically agitating the hopper, spacing the outlet of the hopper away from the open end of the container so as to overfill the container and, after the steps of mechanically agitating, removing excess powder from the open end of the container.

In particular, it is preferred that the hopper fills the container and powder is caused to settle in the container before the hopper is moved away from the open end of the container. By further agitating the hopper when spaced from the open end of the container, it is ensured that the container is completely filled with powder. This overcomes the possibility that, when the hopper is moved away from the open end of the container, it takes with it some powder from the top of the container.

Preferably the method further includes positioning the outlet of the hopper across the open end of the container such that the container is filled level with the open end.

In this way, the outlet of the hopper defines the predetermined volume of powder as being the volume of the container up to a position level with the open end.

Alternatively, the method further includes positioning the outlet of the hopper at a predetermined level within the container so as to define, with the container, the predetermined volume, the predetermined volume being smaller than the volume of the container.

In this way, the container can still be used to defme a predetermined volume. However, since the outlet of the hopper extends to a position within the container, the top surface of the predetermined volume of powder in the container is below the level of the open end. In this way, there is a reduced likelihood of any powder being deposited on the container around its open end. Furthermore, the predetermined volume can easily be adjusted by adjusting the extent to which the outlet of the hopper protrudes into the container.

Preferably the method further includes providing the outlet of the hopper with one of an orifice, mesh, screen and grid to separate the powder in the hopper from the container.

This provides an effective way of maintaining powder in the hopper until the mechanical agitation is provided to the hopper.

Preferably the method further includes providing the orifice, mesh, screen or grid with a hole-size small enough that bulk density powder will not flow through under gravity, but large enough to allow powder to fall through during the step of mechanically agitating.

In this way, the hopper can be moved to and from the container without dropping any significant quantities of powder.

Preferably the method further includes providing the orifice, mesh, screen or grid with a hole-size of approximately 0.5 mm.

Other hole-sizes may be more appropriate depending on the properties of the powder.

Preferably one or both of the steps of mechanically agitating includes tapping the hopper and/or container.

Hence, the hopper and/or container can be tapped to provide the mechanical agitation for transferring the powder and/or settling the powder.

The tapping, unlike mere general non-specific vibration, does not merely cause the powder particles to move around and, hence, flow more freely, but actually provides positive impulses to the powder, in particular to move in a direction determined by the tapping direction. Hence, preferably, the tapping is in a direction from the open end of the container into the container so as to provide impulses to the powder particles in that direction. Usually, where filling occurs by means of gravity, the open end of the container is orientated to face upwards, such that the tapping is provided in a vertical downward direction.

Preferably the steps of mechanically agitating include lifting the hopper and container by 1 to 10 mm, then letting the hopper and container fall under gravity to a substantially fixed position.

This tapping of the hopper and container causes transfer of powder from the hopper to the container and suitable settling of the powder in the container.

Preferably the step of mechanically agitating provides an acceleration of approximately 1000 G to powder in the hopper and container.

This acceleration to the powder can be provided as described above or with any suitable movement of the hopper and/or container. It is appropriate for settling the powder to the required density.

Preferably the steps of mechanically agitating include tapping the hopper and/or the container between 50 and 500 times.

Depending on the nature of the powder and the size of the predetermined volume, this will provide sufficient mechanical agitation to ensure that the container is filled with powder and the powder settles to the required density. There is thus no need to weigh the container.

Preferably the steps of mechanically agitating include vibrating the hopper and/or container.

This is an alternative way of causing transfer of powder and/or settling of the powder. It may be used in conjunction with tapping as described above.

To achieve the required mechanical agitation, it is insufficient to provide general non-specific vibration to the container. General vibration merely causes powder particles to move relative to one another and over one another and, hence, to cause improved flow of powder. While this is useful in causing powder to transfer from the hopper to the container and to cause the powder to completely fill the container, the resulting density of the powder remains insufficiently well-defined.

In order to provide the mechanical agitation required to produce the settling of the powder to the reproducible condition of tap density, it is necessary to arrange the vibrations in the required so as to give the powder particles the impulses as described above for tapping. Indeed, the profile of the vibration movement should also be arranged to move the powder particles in a manner similar to as if they were subjected to tapping. In this sense, vibrations considered as suitable for the mechanical agitation could be considered as a series of consecutive taps, rather than more general non-specific "vibrations" as would normally be understood by the skilled person.

In view of the above, it will be appreciated that tapping is particularly advantageous.

Preferably the method further includes vibrating the hopper and/or container at a frequency between 100 Hz and 1 kHz.

For most general powders, this provides suitable mechanical agitation for transferring and settling the powder.

Preferably the method further includes providing a powder-tight seal between the hopper and container during at least part of the step of mechanically agitating the hopper.

In this way, when the mechanical agitation of the hopper releases powder from the hopper, that powder transfers correctly to the container and does not spill on to surfaces around the container.

Preferably the present invention further includes mechanically connecting the hopper to the container such that mechanical agitation of one of the hopper and container causes mechanical agitation of the other of the hopper and container such that the steps of mechanically agitating the hopper and container are conducted simultaneously by mechanically agitating the hopper and container together.

In this way, it is only necessary to provide the mechanical agitation to the hopper and container as a single unit. For example, the hopper and container can be dropped together as a single unit so as to provide appropriate tapping. Furthermore, vibrations applied to one or other of the hopper and container will vibrate both of the hopper and container.

According to the present invention, there is also provided a method of simultaneously filling with powder a plurality of containers having respective open ends, the method including:

providing a hopper having a plurality of outlets positioning the plurality of outlets above corresponding open ends of the containers; and simultaneously conducting the method defined above for each container.

In this way, a plurality of containers can be filled together. In particular, since the process of mechanical agitation ensures that each of the containers is filled with the same density, it is not necessary to monitor each of the containers separately, for instance by weighing. Hence, it is also possible for the plurality of containers to be provided together in a single carrier.

Following, the methods defined above it is then possible to seal a lidding sheet to the container to seal the powder in place.

According to the present invention, there is also provided an apparatus for filling with powder a container having an open end, the apparatus including:

a support for the container;

a hopper having an outlet and being selectively moveable relative to the support to position the outlet above the open end of a supported container, a dispenser for mechanically agitating the hopper and container so as to cause powder to be transferred from the hopper to the container; and a controller for operating the dispenser by at least a predetermined amount sufficient to ensure that powder in the container reaches a predetermined density.

In particular, the apparatus may be arranged to carry out any of the methods described above, for instance simultaneously filling a plurality of containers, optionally forming part of a single carrier.

The invention will be more clearly understood from the following description, given by way of example only, with reference to the accompanying drawings, in which:

FIGS. 1(*a*) and (*b*) illustrate an embodiment of the present invention;

Figure 4A:
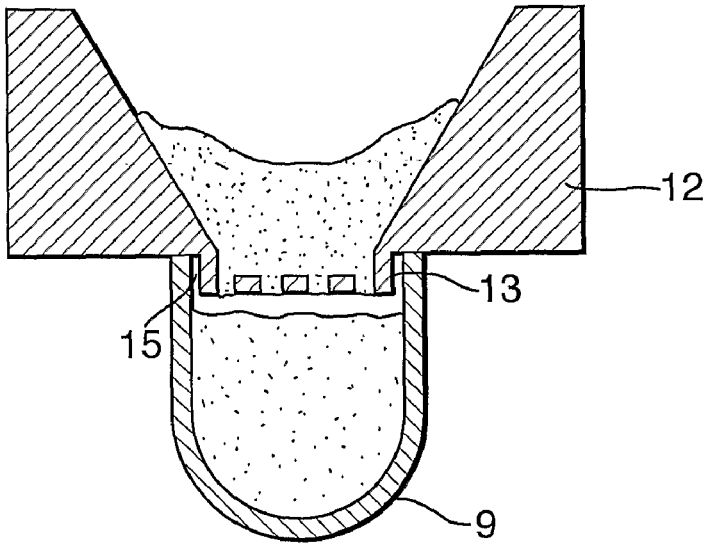
Figure 5:
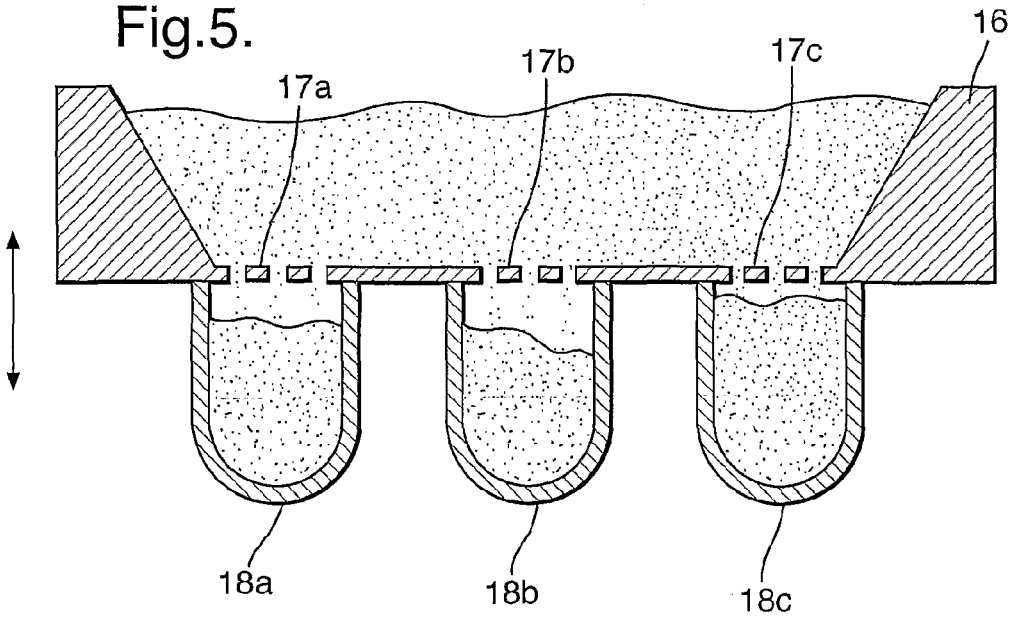
Figure 6A:
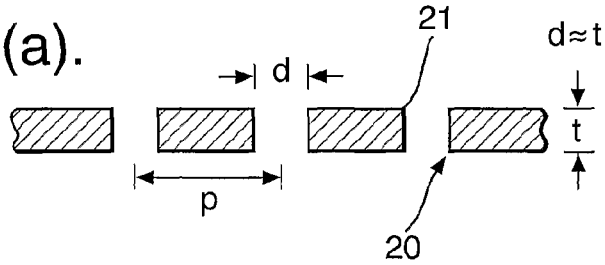
Figure 6B:
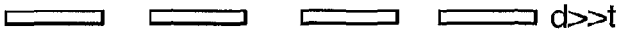
Figure 6C:
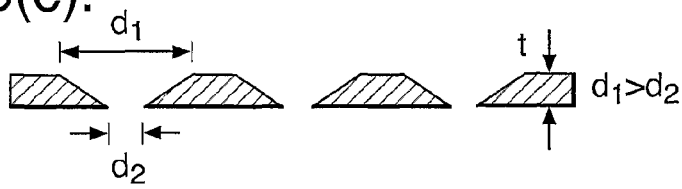
Figure 6D:
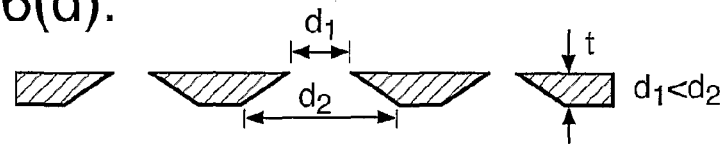
Figure 6E:
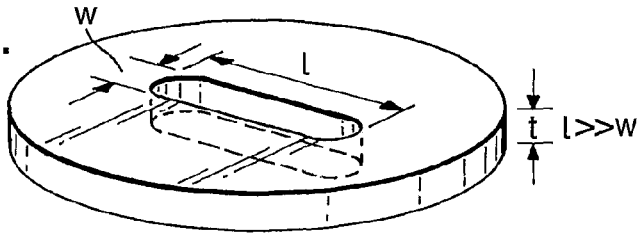
Figure 7:
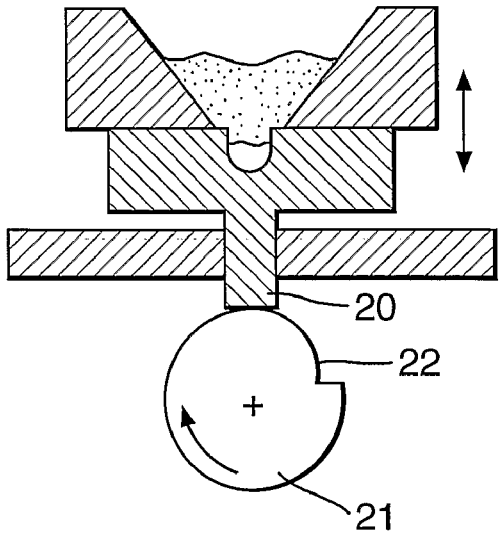
Figure 8:
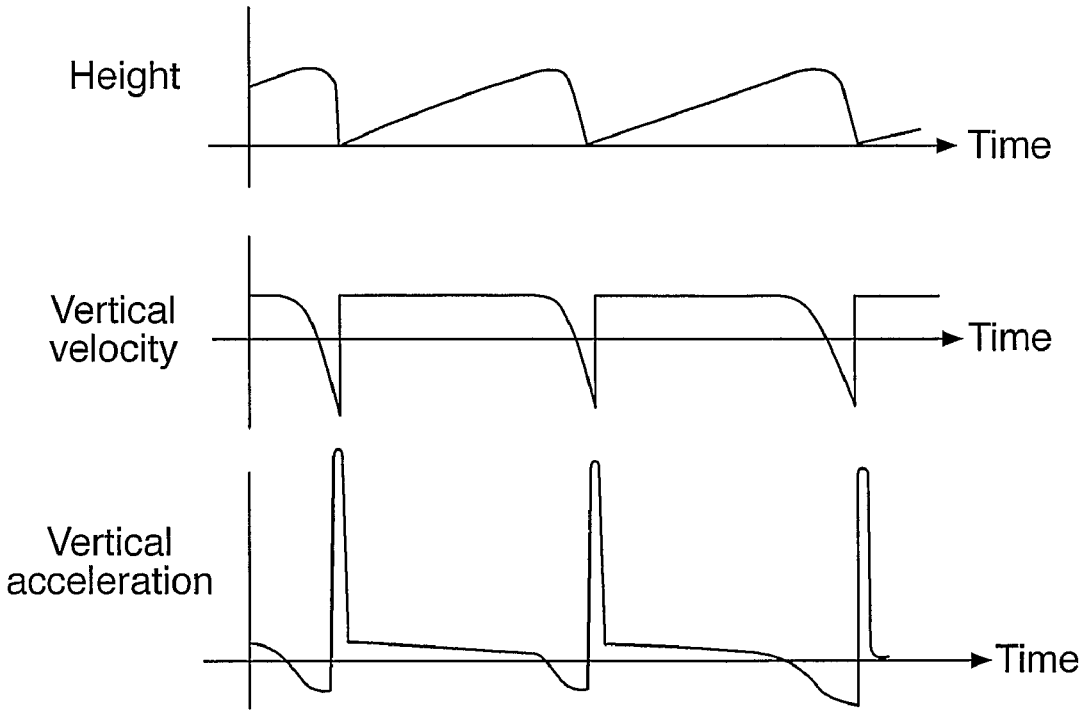

FIGS. 4(*a*) and (*b*) illustrate an alternative method and hopper according to the present invention;

FIG. 5 illustrates one example of the present invention applied to a plurality of containers;

FIG. 6(*a*) to (*e*) illustrate alternative arrangements for the outlet of the hopper according to the present invention;

FIG. 7 illustrates schematically an arrangement for providing taps to a container and hopper according to the present invention; and FIG. 8 illustrates the position, velocity and acceleration profiles against time.

There is a requirement to fill a container with a predetermined mass of a powdered drug or drug and excipient formulation Where the volume of the container can be accurately controlled, then the mass of powder that would fill the container can also be accurately controlled if the powder in the container has a uniform and reproducibly density.

Factory filled unit dose DPI's need to be accurately filled at high speed. Many DPI's have arrays of containers on a plane surface. It is advantageous for achieving rapid filling of a number of the containers in parallel rather than sequentially.

It is useful to be able to trim the dose mass by a small amount (~±5%), without a major equipment change, to enable the filling system to account for small variation in drug concentration on the formulation.

The present application describes a means of using tapping or vibration both to transfer powder from a supply hopper into the container and simultaneously to distribute the powder throughout the container with a uniform and reproducible density.

The supply hopper is fitted with an orifice at the bottom that abuts the opening of the container. The supply hopper and container can be clamped together and both items are then tapped in a way that causes powder to pass through a mesh in the outlet of the hopper into the container under the action of gravity. Tapping or vibration fills the container with powder from the hopper and also settles the powder in the container so that it approaches the reproducible condition known as "tap density". At this point, the hopper and container are separated. The orifice size and shape is chosen so that powder will not fall through them unless tapped and hence the surface of the powder in the container is defined by the position of the mesh during filling.

The method can be used to fill a plurality of containers from a single hopper provided with the necessary number of orifices. Even though some containers will fill before others, providing that sufficient taps are used to ensure all the containers are full, then the density in each will be substantially the same.

The level of fill can be set to be beneath the opening of the container by the use of a hopper with an orifice plate that protrudes through the opening face to a set level within the container.

The method also has the advantage that it fills a container with powder at a high density without compacting the powder in a way that causes cohesive powders to stick together in the pocket.

Figure 1A:
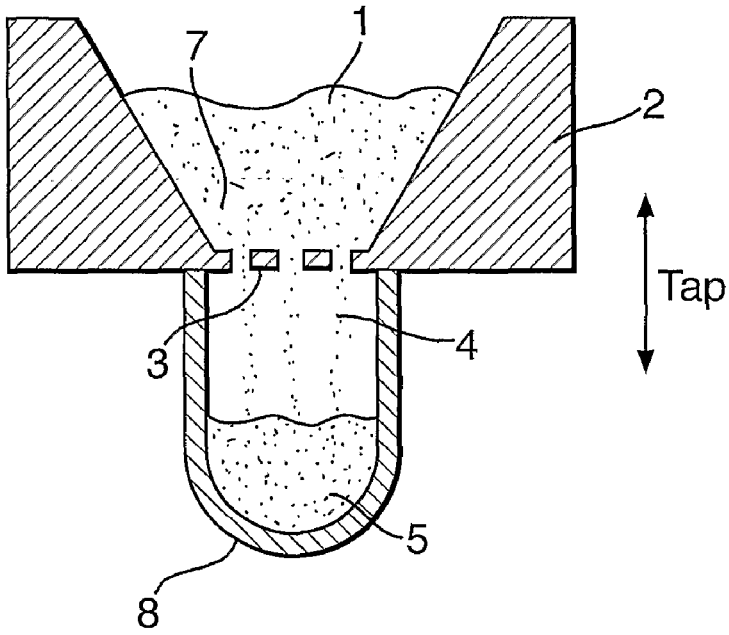
Figure 1B:
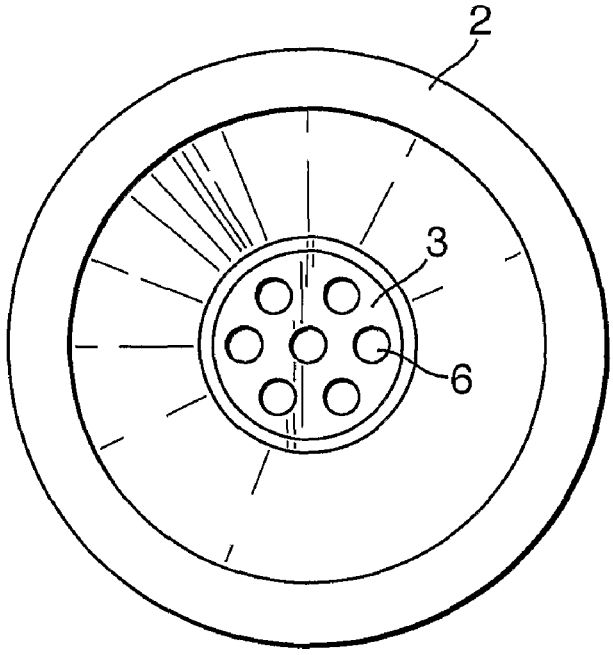

FIG. 1 (*a*) shows a cross section and FIG. 1 (*b*) a top view of a basic arrangement for implementation of the concept Powder 1 is placed in the hopper 2. Hopper 2 has an opening in the bottom 7 whose area is appropriate for the opening of the container 8. The open area of the hopper 7 is covered by a thin plate with holes in it that form an orifice 3. The hopper 2 and the container 8 are clamped together and then tapped. Tapping or vibration is in the form of short pulses of high acceleration. They can take many forms and be applied in various directions depending upon the geometry and powder properties. For the basic example, a tapping or vibration mode is assumed that lifts both hopper and container up to a distance between 1 mm and 10 mm's and then lets them fall under gravity to impact a hard flat surface. This may be achieved by using a cam as shown in FIG. 7 and results in the powder undergoing a rapid deceleration from a downward velocity. The inertia of the powder over the openings in the mesh causes it to fall into the container. On each tap, a discrete mass of powder 4 falls into the container. The nature of the powder is such that the mass transferred on each tap is not very consistent. Hence, an accurate mass cannot be achieved just by tapping or vibration a preset number of times. Tapping or vibration continues past the point that the container is full, i.e. where the powder is touching the underside of the mesh 3. Further tapping or vibration densifies the powder in the container and if tapping or vibration continues a long time the powder will achieve what is known as tap density.

Tap density is a very reproducible property of a powder. Tap density is typically 20% to 100% higher than the bulk density (lightly poured into a container).

It is not necessary to tap by an amount to reach full tap density provided that the condition which is achieved has the necessary repeatability to achieve the filling accuracy required. Typically between 50 and 500 taps have been found to be suitable. Where required, the number of taps may be used to adjust the fill weight of the container to accommodate batch-to-batch variation of the powder.

Figure 2:
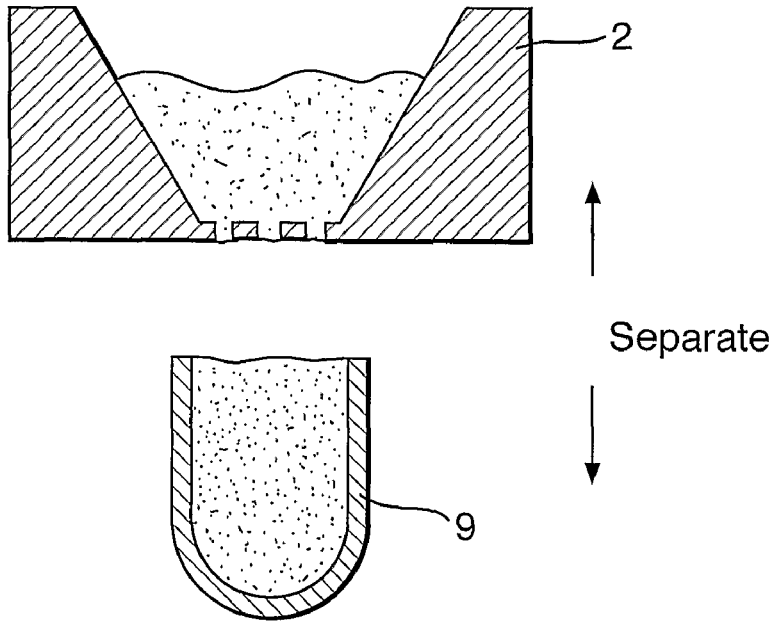
FIG. 2 illustrates separation of a hopper from a container according to the present invention.

After tapping or vibration has finished then the hopper 2 and the full container 9 are separated as shown in FIG. 2 without causing any vibration of the hopper which would be likely to cause powder to fall out of the hopper onto the surfaces surrounding the container. The result is a container full to the brim with powder at a controlled and uniform density. Thus, an accurate fill mass is achieved.

Figure 3:
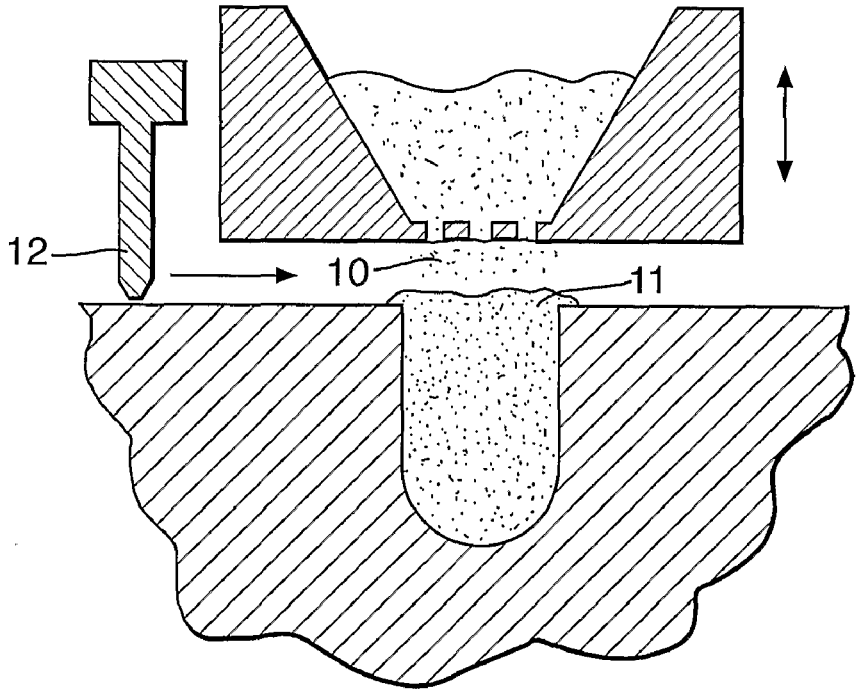
FIG. 3 illustrates an alternative method according to the present invention.

FIG. 3 shows a variation that might be preferred where the powder is extremely cohesive and would stick to the underside of the mesh 10. If the amount stuck varies, then this would adversely affect the accuracy. Hence, for this example, after separation, the hopper is tapped with the container stationary. This deposits powder above the surface 11, ensuring the container is completely full. The excess can then be removed by a doctor blade 12 leaving the container brim full.

FIG. 4 shows another embodiment developed to fill a container to an accurate level and with a reproducible density. In this case the level of fill is below the brim. Here, the mesh plate protrudes downwards in a way that it fully fills the open area of the container at a preset distance below the opening 15.

Filling below the brim makes it easier to seal the container without spilling any powder or having any of the powder get on the sealing surface around the rim of the container.

Figure 4B:
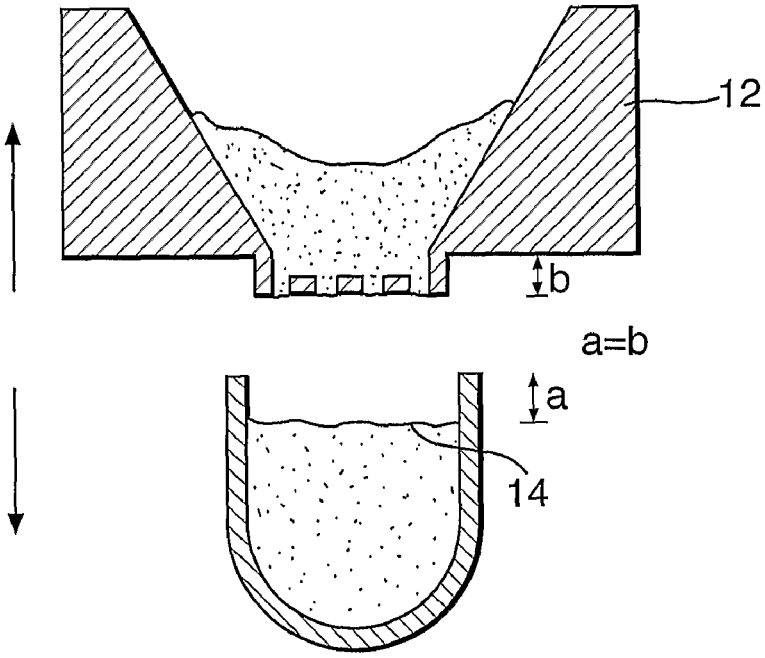

Filling is as described previously. However, the container 9 is only filled to the height at which the mesh plate was located, not to the brim. FIG. 4*b* shows the hopper and container after the filling. It can be seen that the container is filled to a height below the top of the container and that a=b where b is the depth by which the mesh plate protrudes under the hopper. Obviously, the fill depth can be set by the design of the hopper and mesh plate. Small adjustments to the fill height can also be made by shimming the position of the container with respect to the hopper.

FIG. 5 shows another arrangement where the hopper has multiple mesh plates in its base positioned so that several containers can be fitted to the hopper at the same time, each being supplied through its own mesh plate. FIG. 5 shows a single hopper 16 with 3 mesh plates 17*a*, 17*b*, 17*c* and three containers 18*a*, 18*b*, 18*c*.

Filling takes place as before. The FIG. 5 shows the system mid way through the tapping or vibration sequence. As shown, the container 18*c* is almost full whereas container 18*b* is only half full. However, as tapping or vibration continues both containers will be completely filled and the additional tapping or vibration will settle the powder in the container to close to top density. There is no limit to the number of containers that can be filled simultaneously. This enables a rapid filling rate to be achieved. For example, a system that fills 30 containers in parallel using 100 taps at a tap rate of ten per second has an average fill rate of 3 containers/second.

FIG. 6 shows cross sections of various types of mesh plate. FIG. 6(*a*) shows an orifice plate that might be manufactured by milling holes in a sheet of material. For example the plate might have a thickness (t) of 0.5 mm and holes of 0.5 mm diameter (d) drilled in it in a rectangular or hexagonal array of 1 mm pitch (p). Such an orifice plate might be suitable for dispensing powder with particles in the range 0.005 mm to 0.01 mm.

However, it has been noted that such a geometry can cause some variation where the powder separates as the mesh is lifted clear of the powder in the container. Specifically the powder is seen sometimes to separate at the bottom of the hole 20 leaving a plane surface and sometimes at the top of the hole 21 leaving behind a pillar of powder on the surface of the powder in the container.

This uncertainly of the separation point can lead to a significant variation in the fill weight.

FIG. 6(*b*) shows one way to overcome this where the thickness of the mesh plate is made much thinner than the hole diameter. For typical pharmaceutical powders this means an orifice plate thickness in the region of 0.05 mm to 0.1 mm. Whilst such mesh plates are often used and can be readily manufactured by etching or laser machining they are somewhat fragile for a production environment and may vibrate excessively on larger containers where high tapping or vibration forces are being used. FIG. 6(*c*) shows a version with tapered holes with the larger dimension $d_1$, on the hopper side. Such an arrangement causes the powder always to break at the smaller opening $d_2$ at the container side of the plate. The angle of the taper will have an optimum value for any specific powder where too shallow an angle does not force the break off always to be at the bottom and too steep an angle compresses the powder passing through the hole potentially leading to blockages.

FIG. 6(*d*) shows a version with tapered holes with the larger dimension $d_2$ on the container side. In this case the powder will separate-at the hopper side of the plate. However, the large taper angle allows the powder within the hole to drop into the container as the orifice plate is lifted away ensuring that the point of separation is accurately controlled.

These tapered orifices allow a robust and stiff orifice plate to be used whilst maintaining accurate control of the separation location. The selection between positive or negative tapers is governed by the properties of the powder, particularly its cohesiveness.

FIG. 6(*e*) shows an orifice plate with a slot hole instead of an array of circular holes. The retention of powder over a slot is primarily governed by the width of the slot (w) By making the length (1) of the slot much greater than the width a large open area, rapid filling can be achieved along with good powder retention during separation FIG. 7 shows one means of creating the tapping or vibration. The container and hopper are rigidly connected to the follower of a cam 20. The cam profile 21 causes the cam follower to be raised up and then allowed to free fall under gravity and to be rapidly stopped as it impacts the lower cam surface 22. FIG. 8 shows the position, velocity and acceleration profiles plotted against time. The cam profile 21 is designed to lift the hopper with a low acceleration and then to let it all downwards under gravity so as not to cause the powder in the hopper to become air born and then to stop the downward motion of the powder in the hopper and in the container within a very short space of time by impaction with a solid surface. The impact causes a very high peak of acceleration. If the hopper is allowed to fall 3 mm and stops on impact over a distance 3 microns then the peak deceleration would be 1000 g (or ≈ 10,000 m/s$^2$). Powder immediately over a hole in the mesh is unsupported and a portion of it is pushed through the hole into the container. The remaining powder rapidly comes to rest after the impact, typically in less than 0.01 seconds. This repeated tapping or vibration at up to 100 taps per second can be made without changing the behavior compared to a slower rate of tapping or vibration.

It has been noted that some powders fill more uniformly and quickly where a vibration is used rather than discrete taps. Vibration is characterized as being a cyclic motion where the cycle time is short enough that the powder is still in motion at the start of the next cycle. Typically vibration in the frequency range 100 Hz to 1 KHz would be suitable. Vibration can be used either vertically or horizontally.

Combinations of tapping or vibration and vibration can also be advantageous either sequentially or simultaneously. This is especially applicable to cohesive powders where a high tapping or vibration force promotes transfer form the hopper through the mesh and the vibration assists settling and distribution of the powder in the container without compaction.

The invention claimed is:

1. An apparatus for filling with powder a container having an open end, the apparatus including: a support for the container; a hopper having an outlet and being selectively moveable relative to the support to position the outlet above the open end of a supported container; a clamp for clamping the hopper and the container together; a dispenser for mechanically tapping the hopper and the container so as to cause powder to be transferred from the hopper to the container, the dispenser being arranged to tap the clamped hopper and container; and a controller for operating the dispenser by at least a predetermined amount sufficient to ensure that powder in the container reaches a predetermined density.

2. A method of filling with powder a container having an open end, the method including: positioning an outlet of a hopper containing powder above the open end of the container; mechanically agitating the hopper so as to cause powder to be transferred from the hopper to the container; and mechanically agitating the container; wherein the hopper and the container are clamped together and the steps of mechanically agitating include tapping the clamped hopper and container by at least a predetermined amount sufficient to ensure that the container is filled with powder at a predetermined density.

3. A method according to claim 2 further including: using the volume of the container to define a predetermined volume for the powder.

4. A method according to claim 3 further including: filling the entire volume of the container with powder, the volume of the container equaling the predetermined volume.

5. A method according to claim 4 further including: for at least some of the step of mechanically agitating the hopper, spacing the outlet of the hopper away from the open end of the container so as to overfill the container; and after the steps of mechanically agitating, removing excess powder from the open end of the container.

6. A method according to claim 4 further including; positioning the outlet of the hopper across the open end of the container such that the container is filled level with the open end.

7. A method according to claim 3 further including: positioning the outlet of the hopper at a predetermined level within the container so as to define, with the container, the predetermined volume, the predetermined volume being smaller than the volume of the container.

8. A method according to claim 2 further including: providing the outlet of the hopper with one of an orifice, mesh, screen and grid to separate the powder in the hopper from the container.

9. A method according to claim 8 further including: providing the orifice, mesh, screen or grid with a hole-size small enough that bulk density powder will not flow through under gravity, but large enough to allow powder to fall through during the step of mechanically agitating.

10. A method according to claim 8 or 9 further including: providing the orifice, mesh, screen or grid with a hole-size of approximately 0.5 mm.

11. A method according to claim 2 wherein the steps of mechanically agitating include lifting the hopper and container by 1 to 10 mm, then letting the hopper and container fall under gravity to a substantially fixed position.

12. A method according to claim 2 wherein the step of mechanically agitating provides an acceleration of approximately 1000 G to powder in the hopper and container.

13. A method according to claim 2 wherein the steps of mechanically agitating include tapping the clamped hopper and container between 50 and 500 times.

14. A method according to claim 2 further including: tapping vibrating the hopper and/or container at a frequency between 100 Hz and 1 kHz.

15. A method according to claim 2, 11 or 12 further including: providing a powder-tight seal between the hopper and container during at least part of the step of mechanically agitating the hopper.

16. A method according to claim 2 including: adjusting the amount of mechanical agitation of the container so as to vary the density of the powder in the container, thereby compensating for batch-to-batch variations in the powder.

17. A method according to claim 2 wherein at least the step of mechanically agitating the container provides impulses to the powder in a direction from the open end of the container into the container.

18. A method of simultaneously filling with powder a plurality of containers having respective open ends, the method including: providing a hopper having a plurality of outlets positioning the plurality of outlets above corresponding open ends of the containers; and simultaneously conducting the method of claim 2, 11 or 12 for each container.

* * * * *